US007194955B1

(12) United States Patent
Clark

(10) Patent No.: US 7,194,955 B1
(45) Date of Patent: Mar. 27, 2007

(54) PRINTING PRESS INK FOUNTAIN ADJUSTMENT SYSTEM

(76) Inventor: James R. Clark, 3149 Verdugo Rd., Los Angeles, CA (US) 90065

( * ) Notice: Subject to any disclaimer, the term of this patent is extended or adjusted under 35 U.S.C. 154(b) by 0 days.

(21) Appl. No.: 11/221,697

(22) Filed: Sep. 8, 2005

(51) Int. Cl.
*B41F 31/02* (2006.01)
*G09F 9/00* (2006.01)

(52) U.S. Cl. ..... 101/365; 116/309

(58) Field of Classification Search ..... 101/365, 101/364; 116/307, 309
See application file for complete search history.

(56) References Cited

U.S. PATENT DOCUMENTS

| | | | | |
|---|---|---|---|---|
| 2,062,154 | A | 11/1936 | Welk | |
| 2,161,943 | A | 6/1939 | Baue | |
| 2,572,554 | A | 10/1951 | Worthington | |
| 2,902,927 | A * | 9/1959 | Ross | 101/365 |
| 3,623,430 | A | 11/1971 | Lessun | |
| 3,727,550 | A | 4/1973 | Easoz et al. | |
| 4,126,091 | A | 11/1978 | Cohen | |
| 4,350,095 | A | 9/1982 | Simeth | |
| 4,378,736 | A | 4/1983 | Sarda | |
| 4,703,691 | A | 11/1987 | Takeuchi et al. | |
| 4,709,635 | A * | 12/1987 | Kubert et al. | 101/484 |
| 5,031,533 | A | 7/1991 | Goodwin | |
| 5,524,540 | A * | 6/1996 | Van Denend | 101/363 |
| 5,694,850 | A | 12/1997 | Pickard | |
| 5,694,851 | A * | 12/1997 | Bruni | 101/365 |
| 6,561,092 | B1 | 5/2003 | Surbrook | |
| 6,584,901 | B1 | 7/2003 | Sarda | |
| 2004/0107853 | A1 | 6/2004 | Keller et al. | |

* cited by examiner

*Primary Examiner*—Judy Nguyen
*Assistant Examiner*—Leo T. Hinze
(74) *Attorney, Agent, or Firm*—Gardner Groff Santos & Greenwald, PC

(57) ABSTRACT

An ink fountain assembly for a printing press has, or can be retrofitted with, a removable template and ink blade adjustment screws having pointer-like knobs. When the template is installed on the assembly, the knobs point to scales printed on the template.

15 Claims, 4 Drawing Sheets

PRINTING PRESS INK FOUNTAIN ADJUSTMENT SYSTEM

BACKGROUND OF THE INVENTION

1. Field of the Invention

The present invention relates generally to printing presses and, more specifically, to adjustment systems and methods for printing press ink fountains.

2. Description of the Related Art

In an offset printing press, ink is contained in an assembly known as a fountain and picked up by a first roller that is partially immersed in the fountain. The first roller transfers the ink to a second roller with which it is in contact. A typical offset printing press ink fountain assembly also includes a mechanism to regulate with considerable precision the amount of ink the first roller picks up and its distribution along the roller. This mechanism typically comprises an ink blade that extends along the length of the first roller and a number of adjustment screws, also known as keys—often a dozen or more in a typical press—spaced along the length of the ink blade at intervals typically on the order of about an inch. Due to the paste-like viscosity of the ink, the blade is needed to press the ink into the roller and thereby ensure good adhesion and, moreover, an even distribution of ink. The adjustment screws control the extent to which the blade presses the ink into the roller. A distal end of each adjustment screw abuts the rear surface of the blade, and a proximal end has a knurled adjustment knob. The blade is somewhat flexible and resiliently biased toward the roller. By turning an adjustment screw, an operator can adjust the gap between the front surface of the blade and the surface of the roller. Turning an adjustment screw such that it extends toward the roller, the distal end pushes the blade against the bias to narrow the gap. Turning an adjustment screw such that it retracts away from the roller, the distal end moves with the blade in the direction the blade is biased to widen the gap. The wider the gap, the thicker the layer of ink that is deposited on the roller.

An operator typically adjusts the screws to suit each printing job. To set up the press, the operator may run some test prints and then adjust one or more of the screws if the prints do not have an even appearance. The operator may make many test prints, each time adjusting some of the screws, until satisfactory results are obtained. This trial-and-error process of adjusting the screws is time-consuming and inconvenient. The screws also can be notoriously difficult to turn, especially by an operator having ink-slicked hands, and the stubby cylindrical screw heads do not provide much leverage. Furthermore, if an operator adjusts the press to suit a first printing job, then makes some prints, and then wishes to run a second printing job, the operator must adjust the press to suit the second printing job. If the operator wishes to return to the first printing job and make some more prints, the operator needs to adjust the press yet again.

Mechanisms have been suggested in the art for facilitating re-adjustment of a printing press so as to note the screw settings for a particular printing job. For example, U.S. Pat. No. 3,623,430 to Lessun describes screws with numeric scales printed on them. After the screws have been adjusted to suit the printing job, the operator can note the settings on the scales. If a job is interrupted by the need to run another job, an operator can later return the press to the settings for the previous job by turning the screws until their scales read as they did previously. Nevertheless, there are deficiencies in this approach, including that the scales are difficult to read and keep clean, and that the system cannot readily be retrofitted to existing presses.

It would be desirable to provide a system for adjusting an offset printing press ink fountain that is easy to use and maintain and that can be retrofitted to existing presses. The present invention addresses these problems and deficiencies and others in the manner described below.

SUMMARY OF THE INVENTION

The present invention relates to an ink fountain assembly for a printing press and to a method and kit for retrofitting the assembly with a user-removable template and ink adjustment screws having elongated, pointer-like knobs. The ink fountain assembly includes a frame, a fountain basin for containing the ink, a roller disposed at least partially in the fountain basin, an ink blade disposed in the fountain basin, and a number of adjustment screws distributed at positions along the blade.

To retrofit a conventional ink fountain assembly, one can add a kit, comprising, in an exemplary embodiment of the invention, a user-removable template and a number of new adjustment screws with elongated, pointer-like knobs. Each of the conventional adjustment screws is removed and replaced with one of the new adjustment screws with elongated, pointer-like knobs.

In some embodiments of the invention, the new screws can be of two different lengths and staggered so that adjacent knobs do not interfere with one another. Thus, although the elongated, pointer-like knobs may be longer than the spacing between them, they do not interfere.

The elongated, pointer-like knobs are not only easier for an operator to grasp and turn than conventional knobs, as their elongated shape provides good grip and leverage, but moreover, each pointer-like knob can point to a corresponding scale on the template. Thus, the operator can adjust the knob as needed for a printing job or run, note the point or setting on the scale to which the knob points, and later (e.g., after another, intervening print job) quickly and easily return the knob to that setting to continue the earlier print job. The template can be removed during a job after the screws have been adjusted.

In addition to facilitating retrofitting an existing printing press, the ease with which the template can be installed and removed aids the process of cleaning it, as it can quickly and easily be removed from the press, cleaned, and replaced on the press. Although the template can have any suitable structure that facilitates easy removal and installation by an operator, in an exemplary embodiment of the invention it has a number of slots corresponding in number and position to the screws, so that it can be slipped over the screws, with the shaft of each screw extending through the corresponding slot.

DETAILED DESCRIPTION

Figure 1:
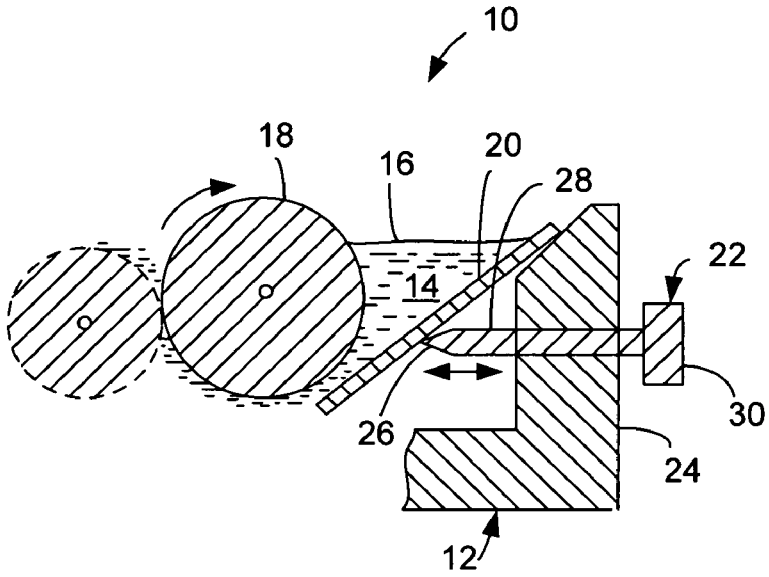
FIG. 1 (PRIOR ART)
FIG. 1 is a generalized cross-sectional view of an printing press ink fountain assembly in accordance with the prior art.

In the following description, like reference numerals indicate like components to enhance the understanding of the invention through the description of the drawings. Also, although specific features, configurations, arrangements and steps are discussed below, it should be understood that such specificity is for illustrative purposes only. A person skilled in the relevant art will recognize that other features, configurations, arrangements and steps are useful without departing from the spirit and scope of the invention.

Figure 2:
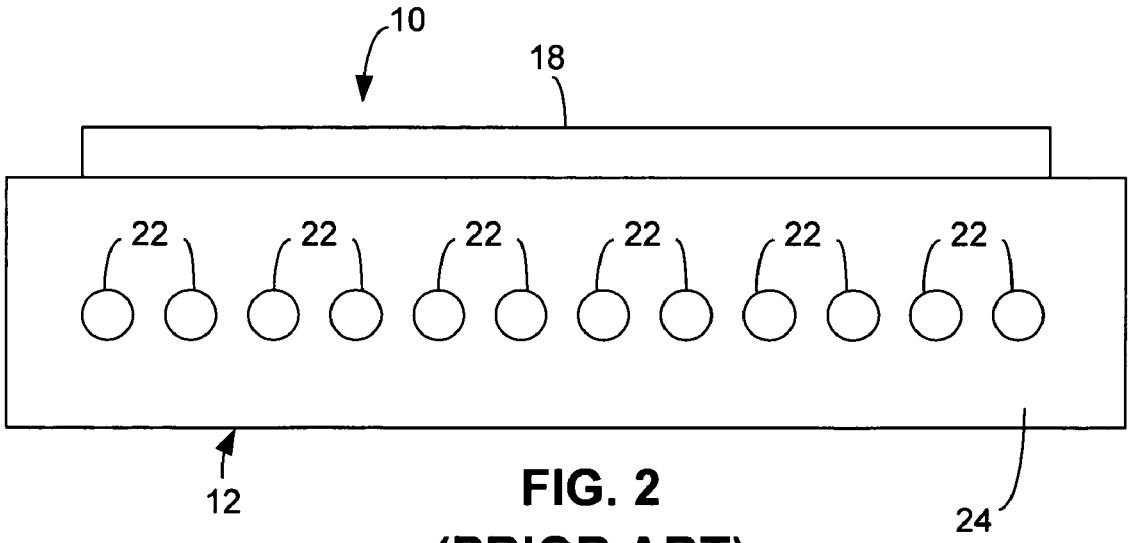
FIG. 2 (PRIOR ART)
FIG. 2 is a front elevational view of the printing press ink fountain assembly illustrated in FIG. 1.
Figure 3:
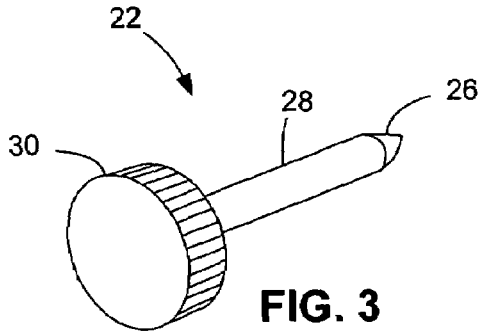
FIG. 3 (PRIOR ART)
FIG. 3 is a perspective view of a conventional adjustment screw of the printing press ink fountain assembly illustrated in FIGS. 1 and 2.

As illustrated in generalized form in FIGS. 1–3, a conventional (i.e., in accordance with the prior art) printing press ink fountain assembly 10 includes a frame 12, a fountain basin 14 for containing the ink 16, a roller 18 disposed at least partially in the fountain basin, an ink blade 20 disposed in fountain basin 14, and a plurality of adjustment screws 22 distributed at positions along blade 20, roller 18 and an operator-accessible portion 24 of frame 12. Each adjustment screw 22 has a distal end 26 contacting a rear surface of ink blade 20, a threaded shaft 28 extending through operator-accessible portion 24 of frame 12, and a proximal end having a cylindrical knob 30. As well-known in the art, a printing press operator or other person can adjust ink blade 20 by turning any of screws 22, as the extension of a screw 22 toward blade 20 narrows the gap between blade 20 and roller 18, and the retraction of a screw 22 away from blade 20 widens this gap. If one's fingers do not slip, the gap can be adjusted in this manner with considerable precision.

Figure 4:
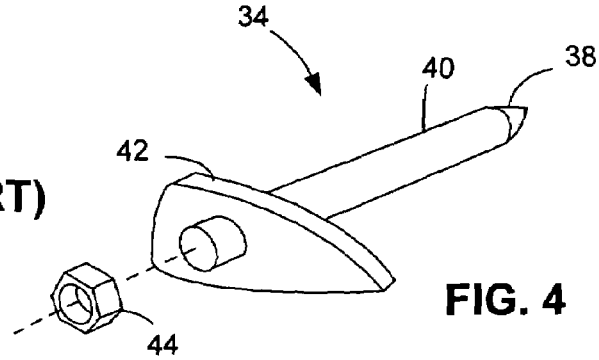
FIG. 4 is a perspective view of an adjustment screw assembly of a printing press ink fountain assembly in accordance with the present invention.
Figure 5:
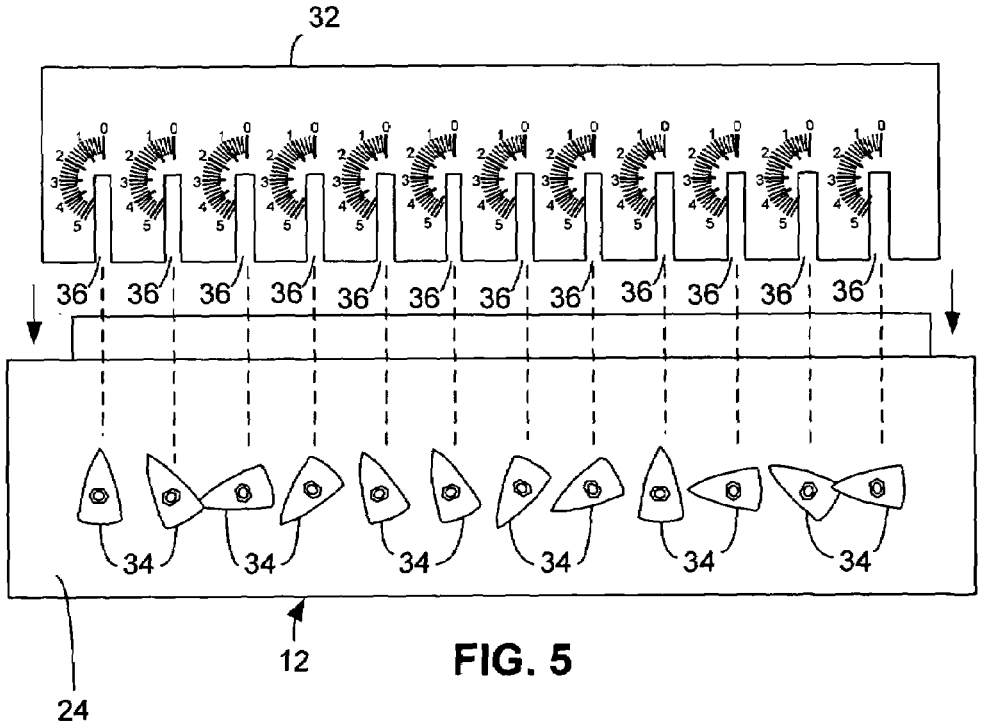
FIG. 5 is a front elevational view of a printing press ink fountain assembly in accordance with the present invention, illustrating the installation of a removable template.

As illustrated in FIGS. 4 and 5, a retrofitting kit comprises a rectangular template 32 and a plurality of new adjustment screw assemblies 34. Template 32 has a plurality of slots 36, corresponding in number to the number of existing adjustment screws 22 of the ink fountain assembly 10 being retrofitted, and uniformly spaced along template 32 at a spacing corresponding to that of the positions of existing adjustment screws 22. At an end of each slot 36, scale indicia are printed in a substantially semicircular arrangement. The scale indicia can be of any suitable type, as its purpose is to indicate with precision the exact position of each adjustment screw assembly 34 from the preset zero position (blade closed). For example, in the exemplary embodiment the scale is numbered from "0" to "5", and marked with major gradations at the numbered points and minor gradations between the numbered points. Note that the substantially semicircular arrangement of the scale indicia accommodates the relatively close spacing between adjacent slots 36, as (the centerlines of) slots 36 can be spaced from one another at spacing intervals less than the diameter of fully circular scale indicia. Template 32 can be made of a suitable ink-resistant plastic or other suitable material.

As best shown in FIG. 4, each new adjustment screw assembly 34 has a distal end 38, an at least partly threaded shaft 40, and a proximal end having an elongated, pointer-like knob 42. For reasons described below, two groups of adjustment screw assemblies 34 can be included in the kit, with adjustment screw assemblies 34 of one group having shafts 40 of a first length and adjustment screw assemblies 34 of another group having shafts of a second length. Also, for reasons discussed below, pointer-like knob 42 can be threaded onto shaft 40 and secured with a locknut 44. Nevertheless, in other embodiments of the invention, the adjustment screws can be unitarily formed.

Figure 6:
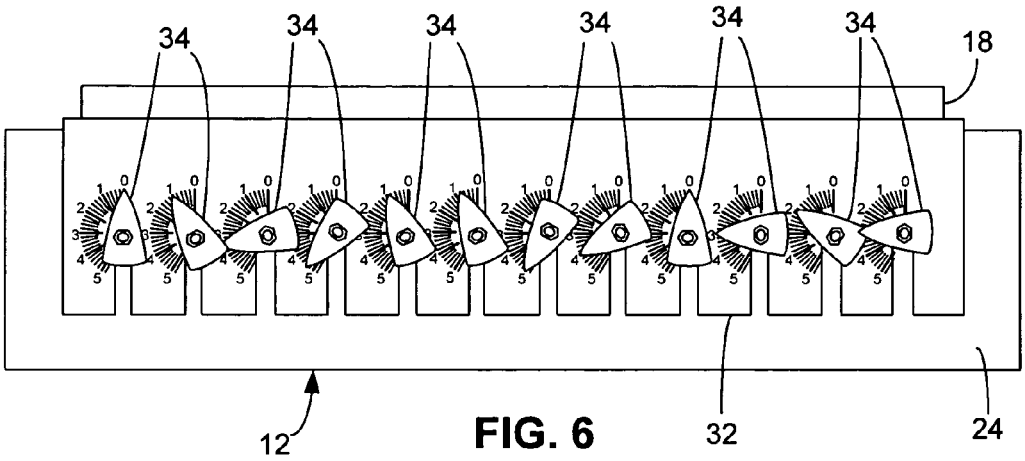
FIG. 6 is a front elevational view of a printing press ink fountain assembly in accordance with the present invention, illustrating the removable template in an installed position.
Figure 7:
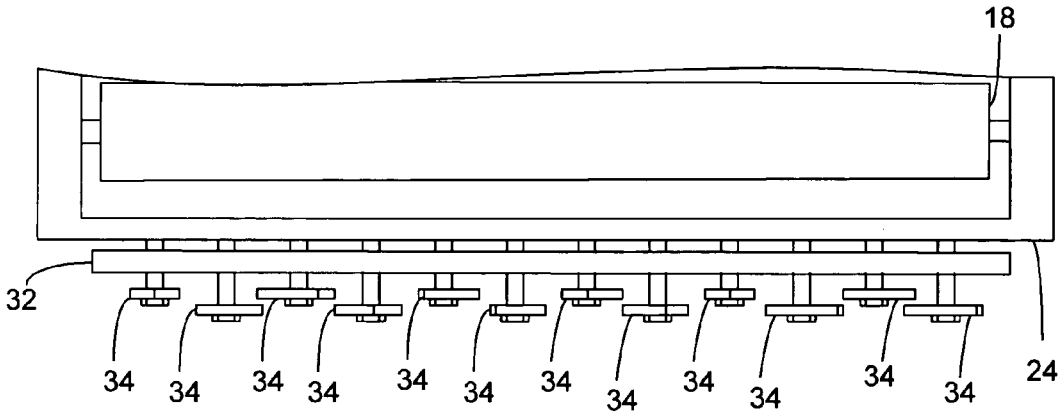
FIG. 7 is a top view of a printing press ink fountain assembly in accordance with the present invention, illustrating the removable template in an installed position.
Figure 8:
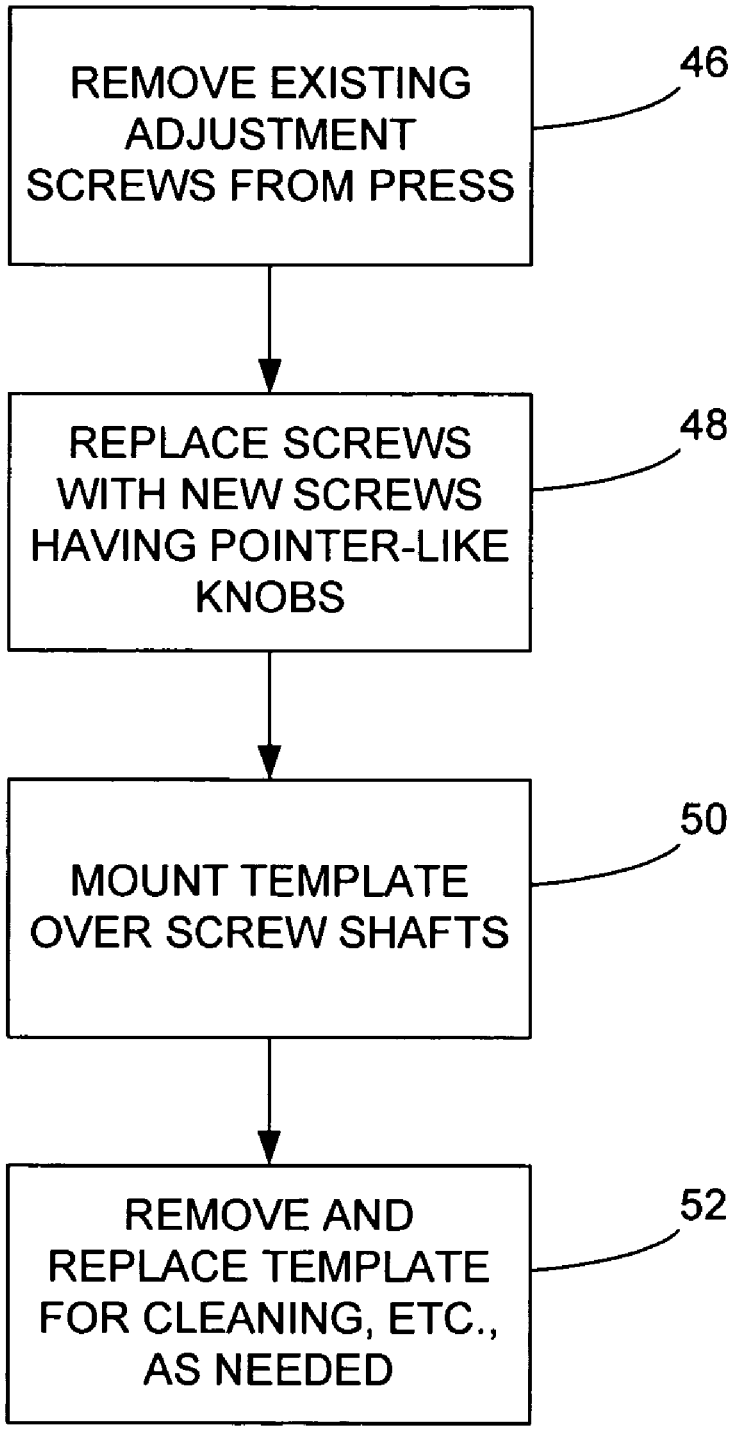
FIG. 8 is a flowchart illustrating a method for retrofitting a printing press ink fountain assembly with pointer-like knobs and a removable template.

With additional reference to the flowchart of FIG. 8, in accordance with a method of the present invention, ink fountain assembly 10 can be retrofitted with the above-described kit. At step 46, the existing adjustment screws 22 (FIG. 3) are removed from ink fountain assembly 10 by unscrewing them. At step 48, new adjustment screw assemblies 34 (FIG. 4) are installed in ink fountain assembly 10 by screwing them into the positions formerly occupied by adjustment screws 22. New adjustment screw assemblies 34 of the first length are installed in an alternating manner with new adjustment screw assemblies 34 of the second length, such that their pointer-like knobs 42 are staggered, as best shown in FIG. 7. Stated another way, adjustment screw assemblies 34 of the first length are installed at even positions, and adjustment screw assemblies 34 of the second length are installed at odd positions. Thus, even though the length of each elongated, pointer-like knob 42 may be greater than the spacing between adjacent adjustment screw assemblies 34, they do not interfere with one another. Rather, they avoid interference by overlapping, as can be seen in FIGS. 5–7. Note, for example, that adjustment screw assemblies 34 in the second and third positions (starting from the left) are overlapping to some extent, as are adjustment screw assemblies 34 in the eleventh and twelfth positions.

At step 50, template 32 is mounted or installed by slipping it over the portions of shafts 40 between pointer-like knobs 42 and the front or operator-accessible portion 24 of ink fountain assembly 10. That is, each shaft 40 slips into a correspondingly positioned one of slots 36. Template 32 is shown installed in this manner in FIGS. 6 and 7. Once template 32 is installed, screw assemblies 34 can be adjusted in essentially the conventional manner to suit a particular print job.

As noted above with regard to FIG. 4, pointer-like knob 42 can be threaded onto shaft 40 and secured with a locknut 52. Locknuts or other means for calibrating or zeroing-out the adjustment screws are useful because an operator can turn each screw until blade 20 (see FIG. 1) is fully closed, rotate pointer-like knob 42 on shaft 40 until it points to "0" on the corresponding scale, and then use locknut 52 to secure pointer-like knob 42 against movement with respect to shaft 40. In this manner, new adjustment screw assemblies 34 can be calibrated or zeroed prior to adjusting them for a print job. In embodiments of the invention that include such zeroing means, screw assemblies 34 can be adjusted to suit successive print jobs after screw assemblies 34 are initially zeroed.

Once installed, template 32 can be removed and replaced (i.e., re-installed) as desired, for cleaning or other purposes, as indicated by step 52. For example, it may be desired to remove template 32 between printing jobs so that it does not become soiled with ink, does not interfere with operation, or other reasons. By noting the position of each pointer-like knob 42 with respect to the corresponding scale, an operator can return screw assemblies 34 to their previous settings after having re-adjusted them for another print job if it is desired to return to the previous print job.

Although described as a retrofitting kit in an exemplary embodiment of the invention, it should be noted that the combination of template 32 and the plurality of new adjustment screw assemblies 34 can be included as part of a newly manufactured printing press or ink fountain assembly in other embodiments of the invention.

Although in the exemplary embodiment of the invention template 32 and adjustment screw assemblies 34 have the structures described above, in other embodiments template 32 can have the above-described structure or a similar structure while the adjustment screws can have a different structure or a conventional structure. Similarly, although in the exemplary embodiment of the invention template 32 has slots 36, in other embodiments the template can have any other suitable means for removably mounting it. Also, generally speaking, the pointer-like structure of the knobs, the means for removably mounting the template, the semi-circular arrangement of the scale indicia and corresponding relatively close spacing between adjacent slots, and other features of the exemplary embodiment as described above can be included or omitted and combined with each other or with still other features in any suitable combinations in other embodiments of the invention.

It will be apparent to those skilled in the art that various modifications and variations can be made to this invention without departing from the spirit or scope of the invention. Thus, it is intended that the present invention covers the modifications and variations of this invention provided that they come within the scope of any claims and their equivalents. With regard to the claims, no claim is intended to invoke the sixth paragraph of 35 U.S.C. Section 112 unless it includes the term "means for" followed by a participle.

What is claimed is:

1. An ink fountain assembly for a printing press, comprising:

a frame;

a fountain basin for containing ink connected to the frame;

a roller disposed at least partially in the fountain basin;

a blade disposed in the fountain basin extending parallel to the roller and an operator-accessible portion of the frame and having a front surface facing the roller;

a plurality of adjustment screws distributed at positions along the blade, roller and operator-accessible portion of the frame, each screw having a distal end contacting a rear surface of the blade, a threaded shaft extending through the operator-accessible portion of the frame, and a proximal end having an elongated pointer-like knob; and a user-removable template attachable to and removable from the frame without fasteners, the template disposed between the pointer-like knob and the operator-accessible portion of the frame and having scale indicia to which the knobs are pointable, wherein the user-removable template has a plurality of slots corresponding in number and position to the plurality of adjustment screws and has scale indicia extending around an end of each slot, the template removably mountable with the threaded shaft of each adjustment screw extending through the end of each slot, whereby, when the template is mounted, each pointer-like knob points to a scale and the template is supported on the frame entirely by the threaded shafts extending through the ends of the slots.

2. The ink fountain assembly claimed in claim 1, wherein the user-removable template is made of ink-resistant plastic.

3. The ink fountain assembly claimed in claim 1, wherein the plurality of adjustment screws are distributed at even and odd positions along the blade, with adjustment screws at even positions having a first length and adjustment screws at odd positions having a second length to stagger the proximal ends.

4. The ink fountain assembly claimed in claim 3, wherein the user-removable template has a plurality of slots corresponding in number and position to the plurality of adjustment screws and has scale indicia extending around an end of each slot, the template removably mountable with the threaded shaft of each adjustment screw extending through the end of each slot, whereby, when the template is mounted, each pointer-like knob points to a scale.

5. The ink fountain assembly claimed in claim 4, wherein the scale indicia extending around an end of each slot has a scale diameter, and the slots are uniformly spaced at a spacing less than the scale diameter.

6. The ink fountain assembly claimed in claim 1, further comprising means for zeroing the adjustment screws.

7. A kit for retrofitting an ink fountain assembly having a frame, a fountain basin for containing ink connected to the frame, a roller disposed at least partially in the fountain basin, and a blade disposed in the fountain basin extending parallel to the roller and an operator-accessible portion of the frame and having a front surface facing the roller, the kit comprising:

a plurality of adjustment screws mountable through the operator-accessible portion of the frame, each screw having a distal end for contacting a rear surface of the blade and a proximal end having a threaded pointer-like knob threadably rotatable on the adjustment screw for zeroing the adjustment screw; and a user-removable template mountable to and removable from the frame without fasteners between the pointer-like knob and the operator-accessible portion of the frame and having scale indicia to which the knobs are pointable, wherein the template has a plurality of slots corresponding in number and position to the plurality of adjustment screws and having scale indicia extending around an end of each slot, the template removably mountable with the threaded shaft of each adjustment screw extending through the end of each slot, whereby, when the template is mounted, each pointer-like knob points to a scale and the template is supported on the frame entirely by the threaded shafts extending through the ends of the slots.

8. The kit claimed in claim 7, wherein the template is made of ink-resistant plastic.

9. The kit claimed in claim 7, wherein the plurality of adjustment screws comprises a first group and a second group, and each screw of the first group has a first length and each screw of the second group has a second length.

10. The kit claimed in claim 9, wherein the scale indicia extending around an end of each slot has a scale diameter, and the slots are uniformly spaced at a spacing less than the scale diameter.

11. A method for retrofitting an ink fountain assembly having a frame, a fountain basin for containing ink connected to the frame, a roller disposed at least partially in the fountain basin, a blade disposed in the fountain basin extending parallel to the roller and an operator-accessible portion of the frame and having a front surface facing the roller, and a plurality existing screws for adjusting the blade, the method comprising:

removing the existing screws from the ink fountain assembly;

installing in place of the existing screws a plurality of pointer-like screws through the operator-accessible portion of the frame, each pointer-like screw having a threaded shaft, a distal end for contacting a rear surface of the blade, and a proximal end having an elongated pointer-like knob; and mounting a template between the pointer-like knob and the operator-accessible portion of the frame, the template having scale indicia to which the knobs are pointable and a plurality of slots corresponding in number and position to the plurality of pointer-like screws, whereby, when the template is mounted, the template is supported on the frame entirely by the threaded shafts extending through the ends of the slots.

12. The method claimed in claim 11, wherein the template is made of ink-resistant plastic.

13. The method claimed in claim 11, wherein the plurality of pointer-like screws consists of a first group and a second group, and each pointer-like screw of the first group has a first length and each pointer-like screw of the second group has a second length.

14. The method claimed in claim 13, wherein the scale indicia extending around an end of each slot has a scale diameter, and the slots are uniformly spaced at a spacing less than the scale diameter.

15. The method claimed in claim 11, further comprising the step of zeroing the pointer-like screws.

* * * * *